US005662537A

United States Patent [19]

Zuber

[11] Patent Number: 5,662,537

[45] Date of Patent: Sep. 2, 1997

[54] TETHERED BASEBALL BATTING PRACTICE APPARATUS

[76] Inventor: Gary T. Zuber, 4962 Caroline La., Fallbrook, Calif. 92028

[21] Appl. No.: 665,018

[22] Filed: Jun. 11, 1996

[51] Int. Cl.[6] ..... A63B 69/40

[52] U.S. Cl. ..... 473/426

[58] Field of Search ..... 273/317.8; 473/393, 473/423, 426, 429, 430, 506, 507, 508

[56] References Cited

U.S. PATENT DOCUMENTS

| | | | |
|---|---|---|---|
| 2,697,603 | 12/1954 | Haines | 473/30 |
| 3,006,647 | 10/1961 | Haskett . | |
| 3,367,655 | 2/1968 | Navron | 473/30 |
| 4,462,599 | 7/1984 | Brown | 473/30 |
| 4,647,042 | 3/1987 | Bruce | 473/30 |
| 4,793,612 | 12/1988 | Hammond . | |
| 5,048,828 | 9/1991 | Love | 473/30 |
| 5,246,226 | 9/1993 | McGuinn . | |
| 5,271,618 | 12/1993 | Malwitz . | |
| 5,340,101 | 8/1994 | Lawson | 473/26 |
| 5,386,986 | 2/1995 | Gamboa | 473/30 |
| 5,454,561 | 10/1995 | Smith . | |
| 5,458,326 | 10/1995 | Marcyes | 473/26 |
| 5,460,364 | 10/1995 | Ring | 473/30 |
| 5,480,141 | 1/1996 | Wood . | |

*Primary Examiner*—Theatrice Brown
*Attorney, Agent, or Firm*—Loyal McKinley Hanson

[57] ABSTRACT

A batting practice apparatus includes a ball, an elongated support arm made from PVC pipe and various PVC fittings, and a strand of flexible material tethering the ball from the support arm. A PVC adapter fitting is provided on the first end portion of the support arm for removably attaching the support arm to a separate mounting member. A PVC tee fitting is provided on the second end portion of the support arm for providing a rotatable structure on the support arm. A PVC plug fitting is secured to the PVC tee fitting, and the strand is secured to the PVC plug fitting. Various mounting members are disclosed to mount the apparatus on various existing support structures, including a post, a chain-link fence, and an umbrella stand base.

13 Claims, 4 Drawing Sheets

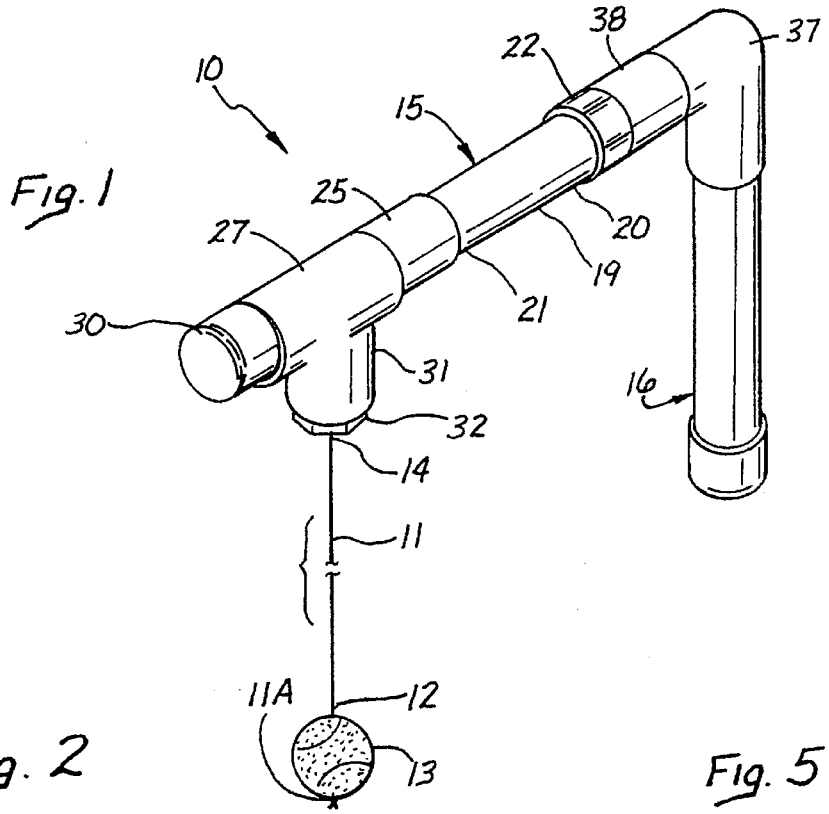
Fig. 1
Fig. 2
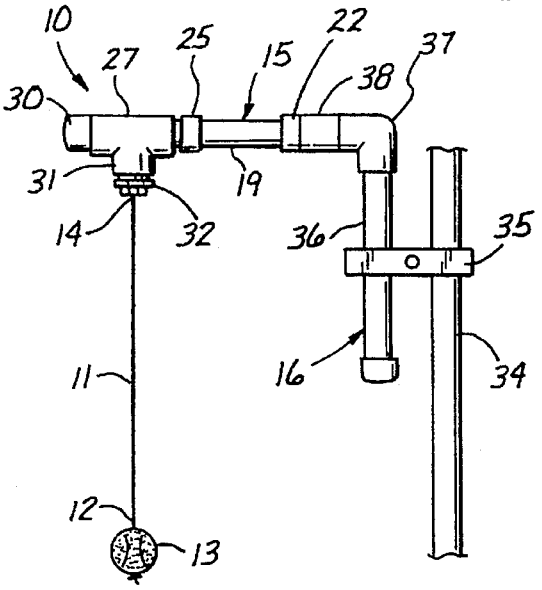
Fig. 5
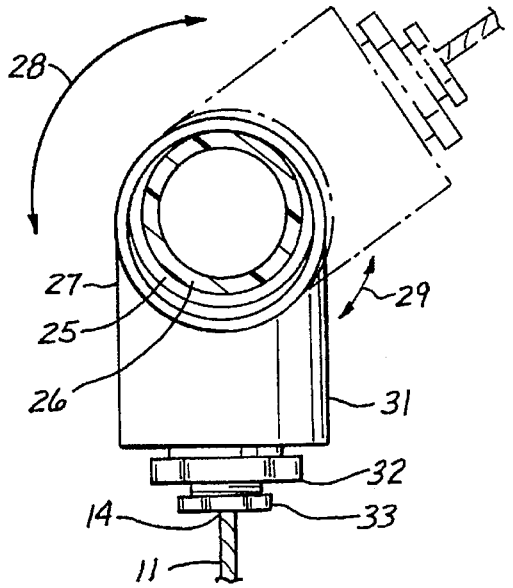

TETHERED BASEBALL BATTING PRACTICE APPARATUS

BACKGROUND OF THE INVENTION

1. Technical Field

This invention relates generally to athletic training equipment, and more particularly to a baseball batting practice apparatus that includes a tethered ball attached to a horizontal support arm.

2. Description of Related Art

Various existing batting practice devices include a tethered baseball that hangs on a flexible strand from a horizontal support arm. That arrangement eliminates the need for a pitcher and a ball chaser and it enables a baseball or T-ball enthusiast to practice alone within the backyard or other limited space. When the ball is hit, it rotates about the support in a vertical plane and eventually comes to rest for the next swing.

But existing devices have certain drawbacks that need to be overcome. They may mount on chain link fences or posts or include their own dedicated stand. In any case, they may be somewhat complicated, expensive, and/or inconvenient to use, and some can be a unsafe for children. Thus, baseball and T-ball enthusiasts need a better design.

SUMMARY OF THE INVENTION

This invention solves the problems outlined above by providing an apparatus having a tethered ball that hangs from a horizontal support arm fabricated from polyvinyl chloride (PVC) irrigation pipe and/or electrical conduit components (i.e., PVC pipe and fittings). The support arm includes a nonobvious combination of existing PVC pipe and fittings that makes the apparatus less complicated and less expensive as well as safer and more convenient to use. Among other things, the combination of PVC components utilized enables the support arm to be attached to a selected one of various mounting members so that the apparatus can be mounted equally as well on any of various existing support structures, including a post, a chain-link fence, or an umbrella stand.

To paraphrase some of the claim language subsequently presented, an apparatus constructed according to the invention includes a ball, an elongated support arm made from PVC components, and a strand of flexible material tethering the ball from the support arm. The strand has a first end portion attached to the ball and a second end portion connected to the support arm. The support arm has opposite first and second end portions, the second end portion having a specific outside diameter.

First PVC-fitting means are provided for removably attaching the first end portion of the support arm to a separate mounting member that is adapted to be mounted on an existing support structure. The first PVC-fitting means including a first PVC fitting (e.g., a PVC adapter fitting) that has a slip-on port and a threaded port. The slip-on port is secured on the first end portion of the support arm.

Second PVC-fitting means are provided for providing a rotatable structure on the second end portion of the support arm. The second PVC-fitting means including a second PVC fitting (e.g., a PVC tee fitting) that has first, second, and third ports. The first and second ports face oppositely, and each of the first and second ports has an inside diameter slightly larger than the outside diameter of the second end portion of the support arm. The second PVC fitting is disposed on the second end portion of the support arm in a position such that the second end portion of the support arm extends through the first and second ports of the second PVC fitting and the third port faces radially away from the support arm.

In addition, third PVC-fitting means are provided for connecting the second end portion of the strand to the second PVC fitting. The third PVC-fitting means includes a third PVC fitting (e.g., the combination of a PVC plug fitting and a PVC bushing fitting) to which the second end portion of the strand is attached. The third PVC fitting is secured to the third port of the second PVC fitting.

To use the apparatus, the user first screws a selected mounting member on the first PVC fitting and then mounts the apparatus on an existing support structure (e.g., post, chain-link fence, or umbrella stand base). That is done so that the ball is held at a desired height. When hit, the ball remains tethered to the support arm so that a ball chaser is unnecessary. When hit hard enough, the ball swings completely around the support arm as the second PVC fitting rotates about the support arm. The following illustrative drawings and detailed description make the foregoing and other objects, features, and advantages of the invention more apparent.

BRIEF DESCRIPTION OF THE DRAWINGS

FIG. 1 of the drawings is a three-dimensional view of a batting practice apparatus constructed according to the invention;

FIG. 2 is a reduced right side view of the apparatus mounted on a post;

FIG. 5 is a further enlarged front view taken in cross section on line 5—5 of FIG. 4, showing rotational components attaching the tether to the support arm;

DESCRIPTION OF THE PREFERRED EMBODIMENTS

Figure 6:
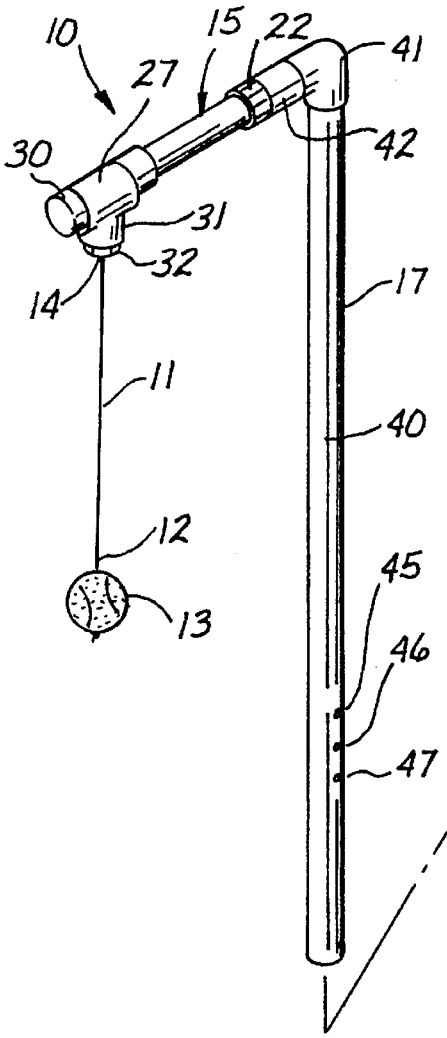
FIG. 6 is a three-dimensional view of the apparatus with a second style vertical member adapted for mounting on an umbrella stand.
Figure 8:
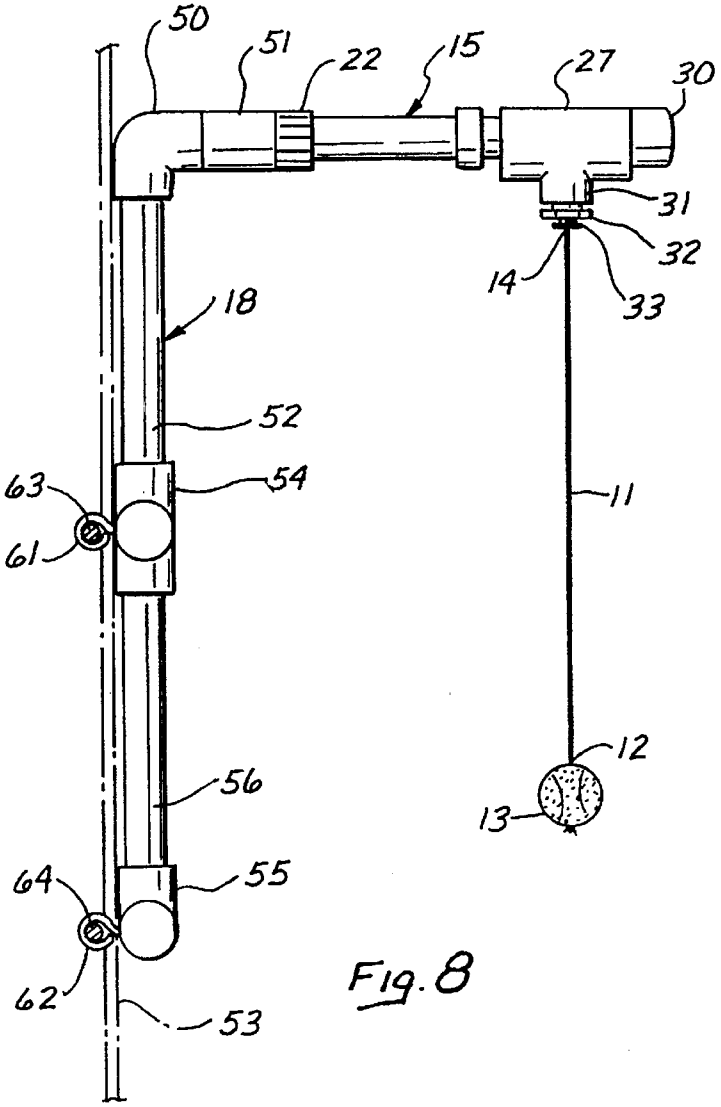
FIG. 8 is an enlarged left side view of the apparatus with the third style vertical member, showing further chain-link fence mounting details.
Figure 7:
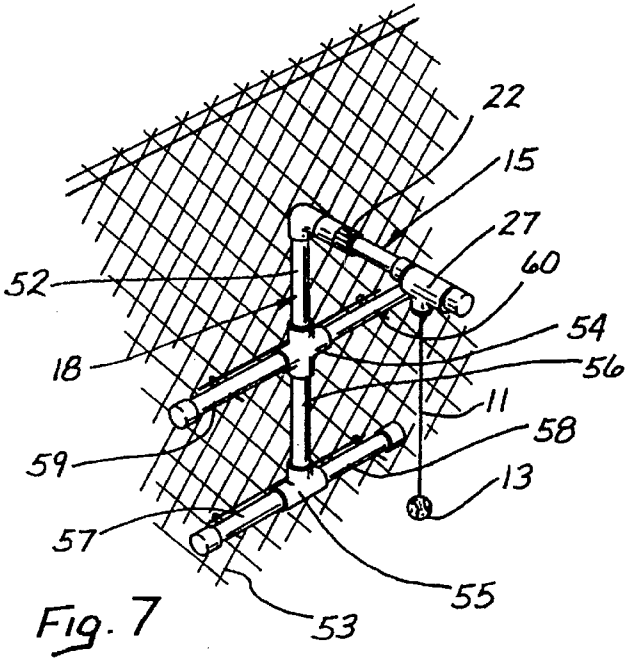
FIG. 7 is a three-dimensional view of the apparatus with a third style vertical member adapted for mounting on a chain-link fence.

The drawings show an apparatus 10 constructed according to the invention. Generally, the apparatus 10 includes a flexible strand or tether 11 (e.g., a 20-inch length of nylon braided rope) having a first end portion 12 attached to a baseball 13 and a second end portion 14 connected to a support arm 15. The support arm 15 attaches to a selected one of various types of mounting members, and so the apparatus 10 is illustrated with a first style mounting member 16 in FIGS. 1–5, with a second style mounting member 17 in FIG. 6, and with a third style mounting member 18 in FIGS. 7–9.

The support arm 15 includes a nonobvious combination of commercially available PVC irrigation pipe and/or electrical conduit components. The nonobvious combination utilized achieves the tethered baseball functions desired, enables convenient attachment to a selected one of various styles of vertical mounting member, and provides a less complicated and less expensive structure that is more convenient and safer to use.

The PVC components are available at any of various hardware stores and manufacturers. One of many existing manufacturers is SFS Corporation of Narberth, Pa. The PVC components include various PVC fittings that slip onto the ends of PVC pipe of various thickness and diameters. The slip-on joints thus formed are secured with a suitable cement or other bonding agent (e.g., the commercially available cement commonly referred to as PVC cement).

Some fittings also have threaded ends or ports for threaded joints. One example of such a fitting is referred to as an adaptor tee fitting for making a three-way pipe joint. The adaptor tee fitting has two oppositely facing, in-line, slip-on ports or sides and one interiorly threaded third port or side. PVC pipe slips into the two slip-on ports and a threaded pipe screws into the threaded third port. Another example (referred to as a female in-line adapter or just female adapter) has one slip-on port and one oppositely facing, in-line, interiorly threaded port. Yet another fitting that mates with the female adapter (a male in-line adapter or just male adapter) has one slip-on port and one exteriorly threaded port that screws into the interiorly threaded port on the female adapter.

Figure 3:
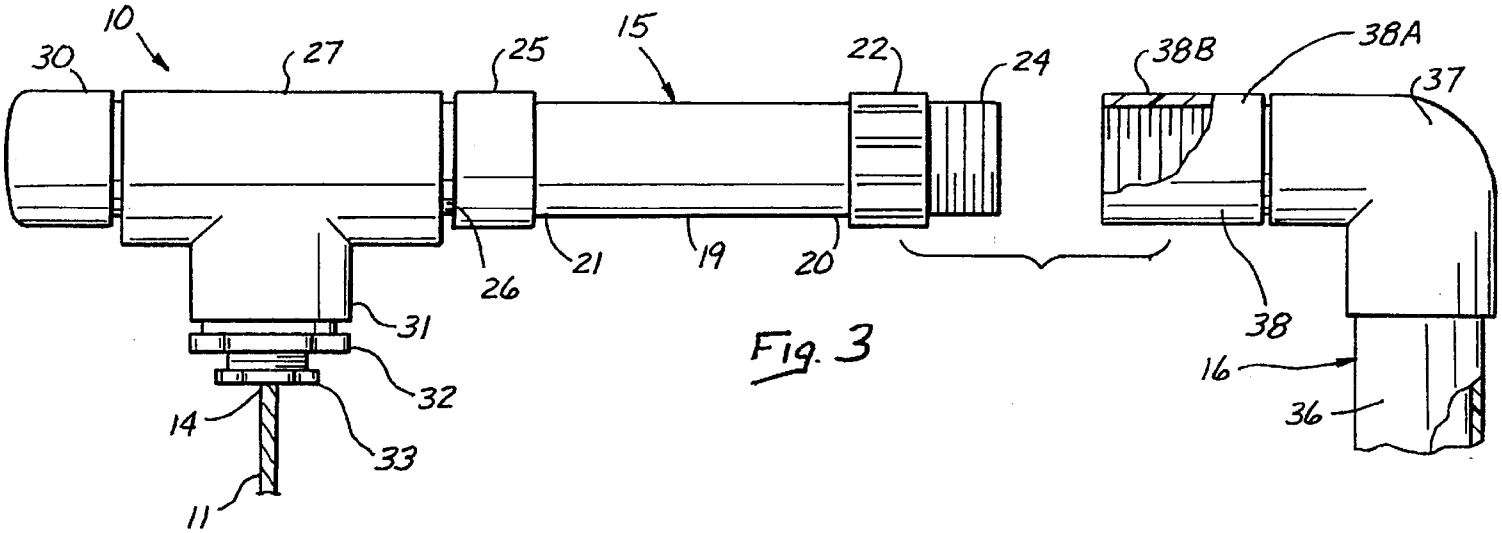
FIG. 3 is an enlarged right side view of the support arm shown partially disassembled.
Figure 4:
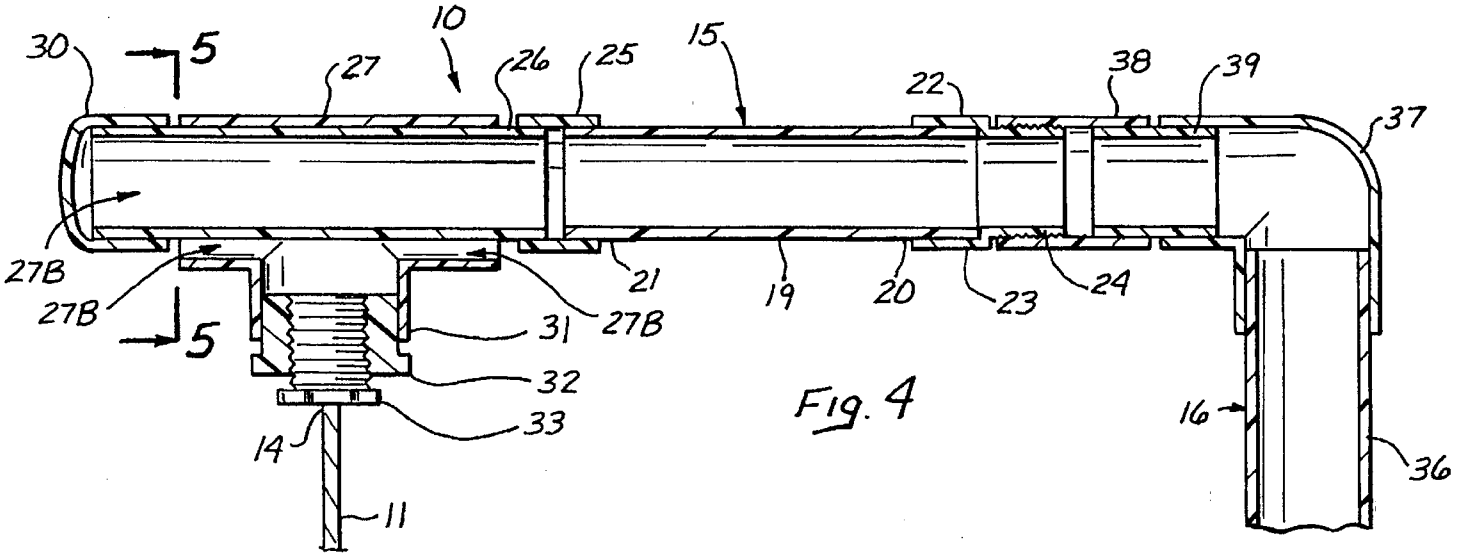
FIG. 4 is a right side view of the support arm shown assembled and in cross section.

The apparatus of this invention cleverly utilizes various ones of those and other selected PVC components as subsequently described. First, the support arm 15 includes a first piece of PVC pipe 19 (FIGS. 1–4) having a first end portion 20 and a second end portion 21 (FIGS. 1, 3, and 4). The first end portion of the first piece of pipe 19 is also sometimes referred to in this description and the claims as a first end portion of the support arm 15. The first piece of pipe 19 may, for example, be a 7-inch length of commercially available 1¼ inch diameter schedule 80 PVC pipe. Of course, "schedule 80" refers to wall thickness, and one of ordinary skill in the art can substitute other thicknesses without departing from the inventive concepts disclosed.

A 1¼ inch PVC male adapter fitting (male adapter 22 visible in all figures except FIGS. 5 and 9) is attached to the first end portion 20 of the first piece of pipe 19 where it serves as means to attach a selected one of various mounting members to the first piece of pipe 19. The male adapter 22 includes a slip-on portion 23 (FIG. 4) that slips on the first end portion 20 of the first piece of pipe 19, and it is secured to the first end portion 20 with PVC cement. Typically, a little over one inch of the first piece of pipe 19 fits into the male adapter. The male adapter 22 also includes an oppositely facing, exteriorly threaded portion 24 (FIGS. 3 and 4) that removably attaches to (screws onto) the selected mounting member as subsequently described further on in this description.

A combination of PVC components attached to the second end portion 21 of the first piece of pipe 19 lengthens the support arm 15 to provide space for a rotatable structure to which the second end portion 14 of the tether 11 is connected. A 1¼ inch PVC coupler fitting, coupler 25, slips on the second end portion 21 of the first piece of pipe 19 (about one inch) where it is secured with PVC cement. The coupler 25 also slips on (about one inch) and is secured with PVC cement to one end of a second piece of schedule 80 PVC pipe 26 (e.g., a 6.5-inch length of PVC schedule 80 pipe). The illustrated support arm 15 is the combination of the first piece of pipe 19, the coupler 25, and the second piece of pipe 26.

The second piece of pipe 26 is also sometimes referred to in this description and the claims as a second end portion of the arm 15, and it extends through a 1½ inch schedule 40 PVC tee fitting (tee 27 visible in FIGS. 1–8) that measures axially about 4⅛ inches long. The tee 27 has oppositely facing first and second ports 27A and 27B (FIG. 4) and an inside diameter slightly larger than the outside of the second piece of pipe 26. As a result, the tee 27 is able to rotate about the second piece of pipe 26 as depicted by double-headed arrows 28 and 29 in FIG. 5.

A 1¼ inch schedule 40 PVC cap fitting (cap 30) slips on (about one inch) and is secured with PVC cement to the other end of the second piece of pipe 26 where it cooperates with the coupler 25 to retain the tee 27 in position on the second piece of pipe 26 (the second end portion of the support arm 15. In other words, the outside diameters of the coupler 25 and the cap 30 are larger than the inside diameter of the tee 27 (although the drawings are not exactly to scale in that respect). As a result, the tee 27 cannot move very much axially (i.e., lengthwise) along the second piece of pipe before abutting the coupler 25 or the cap 30. Of course, the precise dimensions of the PVC pipe and fittings utilized may vary from those given above without departing from the inventive concepts disclosed, and other means may be employed to restrict axial movement of the tee 27.

The tee 27 also includes a slip-on portion 31, that forms a third port facing radially away from the second piece of pipe 26 (FIGS. 1–6 and 8). An interiorly threaded PVC slip-on bushing 32 is secured with PVC cement within the slip-on portion 31, and an exteriorly threaded schedule 40 PVC plug 33 (FIGS. 3–5) is removably secured (i.e., screwed into) the bushing 32. Of course, one of ordinary skill can substitute a tee having a threaded third port for the illustrated tee 27 as subsequently described with reference to a second embodiment of the invention illustrated in FIG. 10.

The second end portion 14 of the tether 14 is connected to the plug 33 by suitable means. For example, a hole may be drilled through the plug 33, with the tether 14 then being strung through the hole and knotted. The tether 14 may be attached to the ball 13 in a similar manner, by stringing the first end portion 12 of the tether 14 through a hole drilled through the ball 13 and then knotting the tether 14 (knot 11A in FIG. 1).

To use the apparatus 10, one first screws it onto a selected mounting member. The mounting member 16 is adapted to be clamped onto another post for that purpose, such as a post 34 in FIG. 2. A known type of clamp may be used. The illustrated clamp 35 is a commercially available chain-link fence component that is designed to be used to clamp to pipes together. It has two sections that bolt together over the pipes.

The mounting member 16 includes a third piece of schedule 80 PVC pipe 36 to which a slip-on ninety-degree schedule 80 PVC elbow 37 fitting is secured with PVC cement (FIG. 1). A second PVC adapter fitting 38 with a slip-on side 38A and an interiorly threaded side 38B (FIG. 3) is attached to the elbow 37 using a short fourth piece of PVC pipe 39 visible in FIG. 4. The slip-on side 38A of the adapter 38 and the elbow 37 are both secured with PVC cement to the fourth piece of pipe 39. The user connects the apparatus 10 to the mounting member 16 by screwing the exteriorly threaded portion 24 of the first adapter 22 into the interiorly threaded side 38B of the adapter 38.

The apparatus 10 may be screwed onto the mounting members 17 and 18 in the same sort of way. The mounting member 17 (FIG. 6) includes a longer fifth piece of PVC pipe 40 that is assembled with an elbow 41 and an adapter 42 in a manner similar to that for the mounting member 16. The fifth piece of pipe 40 slides telescopingly over the post 43 of a conventional umbrella stand. A nut-and-bolt combination 44 is positioned in a selected one of holes 45–47 in the pipe 40 to adjust the height of the apparatus 10.

Figure 9:
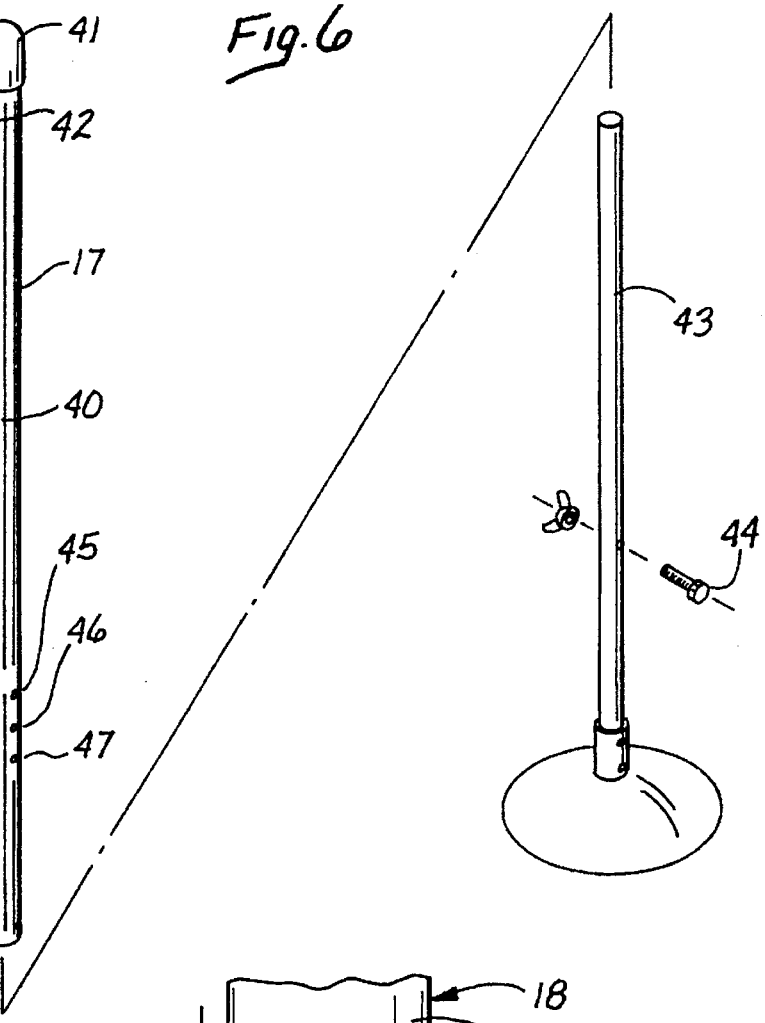
FIG. 9 is a further enlarged portion of the third style vertical member.
Figure 9:
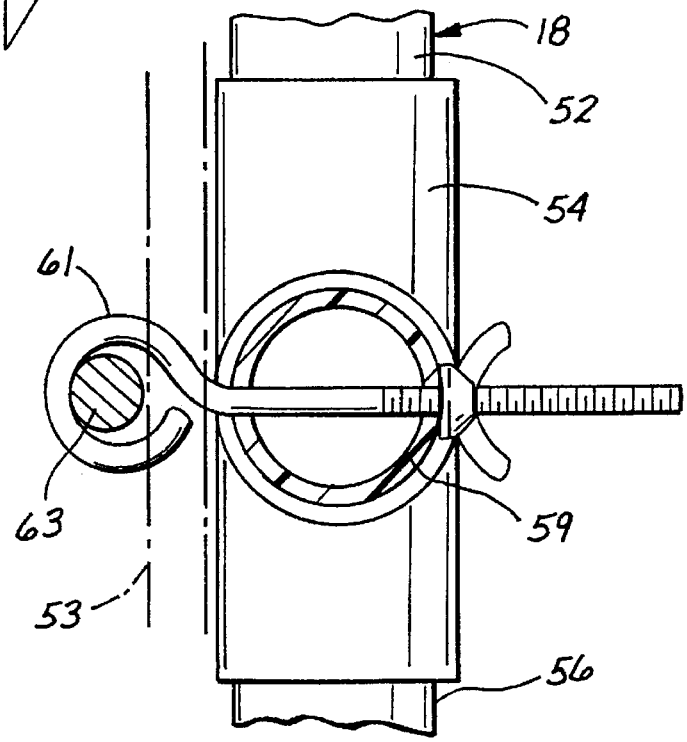

The mounting member 18 (FIGS. 7 and 8) also includes an elbow 50 and adapter 51 that are assembled with a sixth piece of pipe 52 in a manner similar to that for the mounting member 16 for use in mounting the apparatus 10 on a chain-link fence 53. The mounting member 18 also employs a 4-way PVC fitting 54 and 3-way fitting 55 together with five additional pieces of PVC pipe 56–60. Four eyebolts, such as the eyebolts 61 and 62 in FIG. 8, combine with rods 63 and 64 to enable mounting on a chain-link fence while the user remains on one side of the fence. FIG. 9 illustrates the eyebolt-and-rod mounting feature in more detail.

Figure 10:
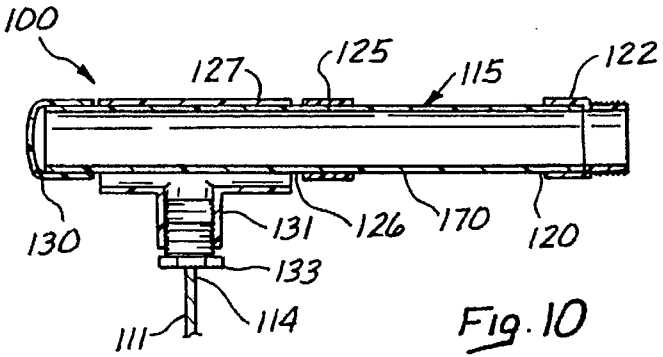
FIG. 10 is a right side view of a second embodiment of the invention having a support arm made of one piece of PVC pipe and a tee adapter with a threaded third port.

As mentioned above, the support arm may be made from just one piece of PVC pipe. FIG. 10 shows a second embodiment of the invention that is designated apparatus 100. The apparatus 100 is similar in many respects to the apparatus 10 and so only differences are described in further detail. For convenience, reference numerals designating parts of the apparatus 100 are increased by one hundred over those designating corresponding parts of the apparatus 10.

Similar to the apparatus 10, the apparatus 100 includes a support arm 115 made from a piece of 1¼ inch schedule 80 PVC pipe 170. A 1¼ inch PVC male adapter 122 is secured with PVC cement to a first end portion 120 of the support arm 115 (a first end of the pipe 170, a 1½ inch schedule 40 PVC tee 127 is disposed rotatably on a second end portion 126 of the support arm 115, and a 1¼ inch schedule 40 PVC cap 130 is secured with PVC cement to an opposite end of the pipe 170.

In addition to using just the one piece of pipe 170, the apparatus 100 is different in that a schedule 40 PVC sleeve 125 is secured on the pipe 170 with PVC cement where it serves to restrict axially movement of the tee 127 (the function performed in the apparatus 10 by the coupler 25). Another difference is that the tee 127 has a interiorly threaded one-inch third port 131 into which an exteriorly threaded schedule 40 PVC plug 133 is screwed (no bushing needed). Apart from those differences, however, the apparatus 100 mounts on a selected one of various mounting members like the apparatus 10.

Thus, the invention provides an apparatus having a tethered ball that hangs from a horizontal support arm fabricated from polyvinyl chloride (PVC) irrigation pipe and/or electrical conduit components. The support arm includes a nonobvious combination of existing PVC pipe and fittings that makes the apparatus less complicated and less expensive as well as safer and more convenient to use. The combination of PVC components utilized enables the support arm to be attached to a selected one of various mounting members so that the apparatus can be mounted equally as well on any of various existing support structures, including a post, a chain-link fence, or an umbrella stand.

Although exemplary embodiments have been shown and described, one of ordinary skill in the art may make many changes, modifications, and substitutions without necessarily departing from the spirit and scope of the invention.

What is claimed is:

1. An apparatus for batting practice, comprising:

a ball, an elongated support arm fabricated at least partially from PVC components, and a strand of flexible material tethering the ball from the support arm, the strand having a first end portion attached to the ball and a second end portion connected to the support arm, and the support arm having a first end portion and an opposite second end portion with a specific outside diameter;

first PVC-fitting means for removably attaching the first end portion of the support arm to a separate mounting member that is adapted to mount on an existing support structure, the first PVC-fitting means including a first PVC fitting that has a slip-on port and a threaded port, the slip-on port being secured on the first end portion of the support arm;

second PVC-fitting means for providing a rotatable structure on the second end portion of the support arm, the second PVC-fitting means including a second PVC fitting that has first, second, and third ports, the first and second ports facing oppositely, and each of the first and second ports having an inside diameter slightly larger than the outside diameter of the second end portion of the support arm, the second PVC fitting being disposed on the second end portion of the support arm in a position such that the second end portion of the support arm extends through the first and second ports of the second PVC fitting and the third port faces radially away from the support arm; and third PVC-fitting means for connecting the second end portion of the strand to the second PVC fitting, the third PVC-fitting means including a third PVC fitting to which the second end portion of the strand is attached, the third PVC fitting being secured to the third port of the second PVC fitting.

2. An apparatus as recited in claim 1, wherein the first PVC fitting is a PVC adapter fitting having a slip-on side and an oppositely facing exteriorly threaded side.

3. An apparatus as recited in claim 1, wherein the second PVC fitting is a PVC tee fitting having three slip-on ports.

4. An apparatus as recited in claim 1, wherein the third PVC fitting is the combination of a PVC plug fitting having an external thread and a PVC bushing fitting having an interior thread.

5. An apparatus as recited in claim 1, wherein the support arm includes first and second PVC pipes joined with a PVC coupler fitting.

6. An apparatus as recited in claim 1, wherein the support arm includes a slip-on PVC cap fitting secured on the second end portion of the support arm.

7. An apparatus as recited in claim 1, further comprising a mounting member adapted to be clamped onto a separate post, the mounting member including a second PVC adapter fitting having a threaded port that mates with the threaded port on the first PVC fitting.

8. An apparatus as recited in claim 7, wherein the mounting member includes a length of PVC pipe and a ninety-degree PVC elbow.

9. An apparatus as recited in claim 1, further comprising a mounting member adapted to be mounted on a chain-link fence.

10. An apparatus as recited in claim 1, further comprising a mounting member adapted to be mounted on a concrete base.

11. An apparatus as recited in claim 1, wherein the support arm is constructed from one piece of PVC pipe.

12. An apparatus as recited in claim 1, wherein the third port of the second PVC fitting is interiorly threaded and the third PVC-fitting means includes an exteriorly threaded PVC plug fitting.

13. An apparatus for batting practice, comprising:

a ball, an elongated support arm fabricated from one piece of PVC pipe and various PVC fittings, and a strand of flexible material tethering the ball from the support arm, the strand having a first end portion attached to the ball and a second end portion connected to the support arm, and the support arm having a first end portion and an opposite second end portion with a specific outside diameter;

first PVC-fitting means for removably attaching the first end portion of the support arm to a separate mounting member that is adapted to mount on an existing support structure, the first PVC-fitting means including a first PVC fitting in the form of a PVC adapter fitting that has a slip-on port and a threaded port, the slip-on port being secured on the first end portion of the support arm;

second PVC-fitting means for providing a rotatable structure on the second end portion of the support arm, the second PVC-fitting means including a second PVC fitting in the form of a PVC tee fitting that has first, second, and third ports, the first and second ports facing oppositely, and each of the first and second ports having an inside diameter slightly larger than the outside diameter of the second end portion of the support arm, the second PVC fitting being disposed on the second end portion of the support arm in a position such that the second end portion of the support arm extends through the first and second ports of the second PVC fitting and the third port faces radially away from the support arm;

third PVC-fitting means for connecting the second end portion of the strand to the second PVC fitting, the third PVC-fitting means including a third PVC fitting in the form of a PVC plug fitting with an external thread, the second end portion of the strand being attached to the PVC plug fitting and the PVC plug fitting being screwed into the third port of the second PVC fitting; and a mounting member adapted to be clamped onto a separate post, the mounting member including a length of PVC pipe, a ninety-degree PVC elbow secured to an end of the PVC pipe, and a second PVC adapter fitting secured to the PVC elbow, the second PVC adapter fitting having a threaded port that mates with the threaded port on the first PVC fitting.

* * * * *